US011846417B2

(12) United States Patent
Go et al.

(10) Patent No.: US 11,846,417 B2
(45) Date of Patent: Dec. 19, 2023

(54) MICRO-MIXER BUNDLE ASSEMBLY, AND COMBUSTOR AND GAS TURBINE HAVING SAME

(71) Applicant: DOOSAN ENERBILITY CO., LTD, Changwon (KR)

(72) Inventors: Young Gun Go, Yongin (KR); Hyun Soo An, Yongin (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 12 days.

(21) Appl. No.: 17/562,100

(22) Filed: Dec. 27, 2021

(65) Prior Publication Data

US 2022/0260250 A1 Aug. 18, 2022

(30) Foreign Application Priority Data

Feb. 17, 2021 (KR) ..... 10-2021-0021072

(51) Int. Cl.

| | |
|---|---|
| ***F23D 14/00*** | (2006.01) |
| ***F23D 14/62*** | (2006.01) |
| ***F23R 3/28*** | (2006.01) |
| ***F23D 14/82*** | (2006.01) |
| ***F23D 14/58*** | (2006.01) |

(52) U.S. Cl.

CPC ..... *F23D 14/62* (2013.01); *F23D 14/58* (2013.01); *F23D 14/82* (2013.01); *F23R 3/286* (2013.01)

(58) Field of Classification Search

None

See application file for complete search history.

(56) References Cited

U.S. PATENT DOCUMENTS

| | | | |
|---|---|---|---|
| 8,875,516 | B2 | 11/2014 | Uhm |
| 10,344,982 | B2 | 7/2019 | Berry |

(Continued)

FOREIGN PATENT DOCUMENTS

| | | | |
|---|---|---|---|
| EP | 02484975 | A1 | 8/2012 |
| JP | 2011027395 | A | 2/2011 |

(Continued)

OTHER PUBLICATIONS

KR Decision to Grant, dated Jul. 26, 2022.

*Primary Examiner* — Edwin Kang

(74) *Attorney, Agent, or Firm* — Harvest IP Law, LLP

(57) ABSTRACT

A micro-mixer bundle assembly and a combustor and a gas turbine having the same are provided. The micro-mixer bundle assembly includes a plurality of micro-mixers, each of the plurality of micro-mixers including an inlet portion formed on one side and through which a first fluid is introduced and a feed hole formed in a circumferential wall and through which a second fluid is fed, wherein the first fluid introduced through the inlet portion and the second fluid fed through the feed hole are mixed to form a fluid mixture which is injected into a combustion chamber, and a plurality of micro-mixer bundles, each of the plurality of micro-mixer bundles including the plurality of micro-mixers arranged therein, wherein a cross-sectional shape of an outlet of the micro-mixers disposed in one of the micro-mixer bundles is different from a cross-sectional shape of an outlet of the micro-mixers disposed in the other micro-mixer bundles.

20 Claims, 12 Drawing Sheets

(56) References Cited

U.S. PATENT DOCUMENTS

| | | | | |
|---|---|---|---|---|
| 2015/0028133 | A1* | 1/2015 | Chong | F23R 3/14 239/418 |
| 2015/0176841 | A1* | 6/2015 | Barker | F23R 3/10 60/737 |
| 2015/0219336 | A1* | 8/2015 | Crothers | F23R 3/46 60/726 |
| 2016/0033133 | A1* | 2/2016 | Johnson | F23R 3/286 60/737 |
| 2016/0033134 | A1* | 2/2016 | Johnson | F23R 3/286 239/589 |
| 2017/0276365 | A1* | 9/2017 | Berry | F23R 3/286 |

FOREIGN PATENT DOCUMENTS

| | | | |
|---|---|---|---|
| JP | 2012149868 | A | 8/2012 |
| JP | 2013160496 | A | 8/2013 |
| JP | 6059426 | B2 | 1/2017 |
| JP | 2017096618 | A | 6/2017 |
| JP | 6231769 | B2 | 11/2017 |
| JP | 6514493 | B2 | 5/2019 |
| JP | 2019215138 | A | 12/2019 |
| KR | 20190040666 | A | 4/2019 |
| KR | 1020200070362 | A | 6/2020 |

* cited by examiner

MICRO-MIXER BUNDLE ASSEMBLY, AND COMBUSTOR AND GAS TURBINE HAVING SAME

CROSS REFERENCE TO RELATED APPLICATION

This application claims priority to Korean Patent Application No. 10-2021-0021072, filed on Feb. 17, 2021, the disclosure of which is incorporated herein by reference in its entirety.

BACKGROUND

1. Field

Apparatuses and methods consistent with exemplary embodiments relate to a micro-mixer bundle assembly and a combustor and a gas turbine including the same.

2. Description of the Related Art

A gas turbine is a combustion engine in which a mixture of air compressed by a compressor and fuel is combusted to produce a high temperature combustion gas which drives a turbine. The gas turbine is used to drive electric generators, aircraft, ships, trains, or the like.

The gas turbine includes a compressor, a combustor, and a turbine. The compressor serves to intake external air, compress the air, and transfer the compressed air to the combustor. The compressed air compressed by the compressor has a high temperature and a high pressure. The combustor serves to mix compressed air compressed by the compressor and fuel and combust the mixture of compressed air and fuel to produce combustion gas which is discharged to the turbine. The turbine blades in the turbine are rotated by the combustion gas to produce power. The generated power is used in various fields such as generation of electricity and driving of mechanical device.

SUMMARY

Aspects of one or more exemplary embodiments provide a micro-mixer bundle assembly capable of solving a combustion instability problem occurring due to high-frequency resonance caused by hydrogen-containing fuel, and a combustor and a gas turbine including the same.

Additional aspects will be set forth in part in the description which follows and, in part, will become apparent from the description, or may be learned by practice of the exemplary embodiments.

According to an aspect of an exemplary embodiment, there is provided a micro-mixer bundle assembly including: a plurality of micro-mixers, each of the plurality of micro-mixers including an inlet portion formed on one side and through which a first fluid is introduced and a feed hole formed in a circumferential wall and through which a second fluid is fed, wherein the first fluid introduced through the inlet portion and the second fluid fed through the feed hole are mixed to form a fluid mixture which is injected into a combustion chamber; and a plurality of micro-mixer bundles, each of the plurality of micro-mixer bundles including the plurality of micro-mixers arranged therein, wherein a cross-sectional shape of an outlet of the micro-mixers disposed in one of the micro-mixer bundles is different from a cross-sectional shape of an outlet of the micro-mixers disposed in the other micro-mixer bundles.

The micro-mixer bundles may be arranged in a radial direction with respect to one of the micro-mixer bundles.

At least one of the outlet cross-sectional shapes of the micro-mixers disposed in each of the micro-mixer bundles may be formed to have a different shape from the other outlet cross-sectional shapes of the micro-mixers.

The micro-mixer may include: an inlet flow path including the inlet portion formed on one side and the feed hole formed in the circumferential wall and through which the fuel mixture flows; an outlet flow path formed at a position spaced apart from an imaginary extension line of the inlet flow path and injecting the fluid mixture into the combustion chamber; and an inclined flow path connecting the inlet flow path and the outlet flow path and formed inclined at a predetermined angle to reduce transfer of radiant heat by a flame generated in the combustion chamber to the inlet flow path.

The inlet flow path may have a first cross-sectional area, the outlet flow path may have a second cross-sectional area greater than the first cross-sectional area, and the inclined flow path may have a variable cross-sectional area that gradually increases from the inlet flow path to the outlet flow path.

The inclined flow path may include a first wall line forming a first angle with the imaginary extension line of the outlet flow path and a second wall line forming a second angle with the imaginary extension line of the outlet flow path, and the first angle and the second angle are different from each other.

The first fluid may be a hydrogen-containing fuel and the second fluid may be air, or the first fluid may be air and the second fluid may be the hydrogen-containing fuel.

According to an aspect of another exemplary embodiment, there is provided a combustor including: a combustion chamber assembly including a combustion chamber in which a fuel fluid combusts; and a micro-mixer assembly including a micro-mixer bundle assembly to inject the fuel fluid into the combustion chamber, the micro-mixer bundle assembly including: a plurality of micro-mixers, each of the plurality of micro-mixers including an inlet portion formed on one side and through which a first fluid is introduced and a feed hole formed in a circumferential wall and through which a second fluid is fed, wherein the first fluid introduced through the inlet portion and the second fluid fed through the feed hole are mixed to form a fluid mixture which is injected into the combustion chamber; and a plurality of micro-mixer bundles, each of the plurality of micro-mixer bundles including the plurality of micro-mixers arranged therein, wherein a cross-sectional shape of an outlet of the micro-mixers disposed in one of the micro-mixer bundles is different from a cross-sectional shape of an outlet of the micro-mixers disposed in the other micro-mixer bundles.

The micro-mixer bundles may be arranged in a radial direction with respect to one of the micro-mixer bundles.

At least one of the outlet cross-sectional shapes of the micro-mixers disposed in each of the micro-mixer bundles may be formed to have a different shape from the other outlet cross-sectional shapes of the micro-mixers.

The micro-mixer may include: an inlet flow path including the inlet portion formed on one side and the feed hole formed in the circumferential wall and through which the fuel mixture flows; an outlet flow path formed at a position spaced apart from an imaginary extension line of the inlet flow path and injecting the fluid mixture into the combustion chamber; and an inclined flow path connecting the inlet flow path and the outlet flow path and formed inclined at a predetermined angle to reduce transfer of radiant heat by a flame generated in the combustion chamber to the inlet flow path.

The inlet flow path may have a first cross-sectional area, the outlet flow path may have a second cross-sectional area greater than the first cross-sectional area, and the inclined flow path may have a variable cross-sectional area that gradually increases the inlet flow path to the outlet flow path.

The inclined flow path may include a first wall line forming a first angle with the imaginary extension line of the outlet flow path and a second wall line forming a second angle with the imaginary extension line of the outlet flow path, and the first angle and the second angle are different from each other.

The first fluid may be a hydrogen-containing fuel and the second fluid may be air, or the first fluid may be air and the second fluid may be the hydrogen-containing fuel.

According to an aspect of another exemplary embodiment, there is provided a gas turbine including: a compressor configured to compress air; a combustor configured to mix the compressed air compressed by the compressor with fuel to produce a fuel fluid and combust the fuel fluid to produce combustion gas; and a turbine generating power with combustion gas produced by the combustor, wherein the combustor includes: a combustion chamber assembly including a combustion chamber in which the fuel fluid combusts; and a micro-mixer assembly including a micro-mixer bundle assembly to inject the fuel fluid into the combustion chamber, wherein the micro-mixer bundle assembly includes: a plurality of micro-mixers, each of the plurality of micro-mixers including an inlet portion formed on one side and through which a first fluid is introduced and a feed hole formed in a circumferential wall and through which a second fluid is fed, wherein the first fluid introduced through the inlet portion and the second fluid fed through the feed hole are mixed to form a fluid mixture which is injected into the combustion chamber; and a plurality of micro-mixer bundles, each of the plurality of micro-mixer bundles including the plurality of micro-mixers arranged therein, wherein a cross-sectional shape of an outlet of the micro-mixers disposed in one of the micro-mixer bundles is different from a cross-sectional shape of an outlet of the micro-mixers disposed in the other micro-mixer bundles.

The micro-mixer bundles may be arranged in a radial direction with respect to one of the micro-mixer bundles.

At least one of the outlet cross-sectional shapes of the micro-mixers disposed in each of the micro-mixer bundles may be formed to have a different shape from the other outlet cross-sectional shapes of the micro-mixers.

The micro-mixer may include: an inlet flow path including the inlet portion formed on one side and the feed hole formed in the circumferential wall and through which the fuel mixture flows; an outlet flow path formed at a position spaced apart from an imaginary extension line of the inlet flow path and injecting the fluid mixture into the combustion chamber; and an inclined flow path connecting the inlet flow path and the outlet flow path and formed inclined at a predetermined angle to reduce transfer of radiant heat by a flame generated in the combustion chamber to the inlet flow path.

The inlet flow path may have a first cross-sectional area, the outlet flow path may have a second cross-sectional area greater than the first cross-sectional area, and the inclined flow path may have a variable cross-sectional area that gradually increases from the inlet flow path to the outlet flow path.

The inclined flow path may include a first wall line forming a first angle with the imaginary extension line of the outlet flow path and a second wall line forming a second angle with the imaginary extension line of the outlet flow path, and the first angle and the second angle are different from each other.

According to one or more exemplary embodiments, it is possible to solve the combustion instability problem due to high-frequency resonance generated by hydrogen-containing fuel.

In addition, it is possible to prevent spontaneous ignition and flashback occurring in the micro-mixer by reducing the transfer of radiant heat from a flame generated in the combustion chamber into the micro-mixer.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
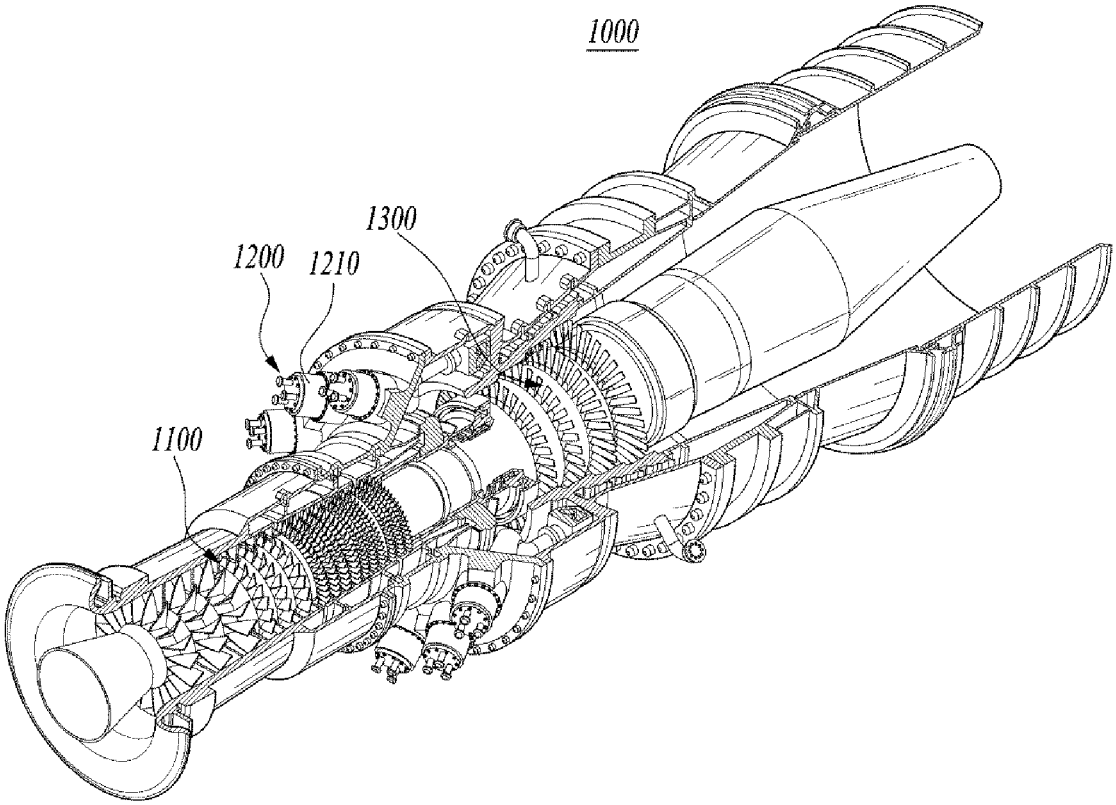
FIG. 1 is a view illustrating an interior of a gas turbine according to an exemplary embodiment.

Various modifications and various embodiments will be described in detail with reference to the accompanying drawings. However, it should be noted that the various embodiments are not for limiting the scope of the disclosure to the specific embodiment, but they should be interpreted to include all of modifications, equivalents or substitutions of the embodiments included within the spirit and scope disclosed herein.

Terms used herein are used to merely describe specific embodiments, and are not intended to limit the scope of the disclosure. As used herein, an element expressed as a singular form includes a plurality of elements, unless the context clearly indicates otherwise. Further, it will be understood that the term “includes” or “including” specifies the presence of stated features, numbers, steps, operations, elements, parts, or combinations thereof, but does not preclude the presence or addition of one or more other features, numbers, steps, operations, elements, parts, or combinations thereof.

Hereinafter, a micro-mixer bundle assembly and a combustor and a gas turbine including the same according to an exemplary embodiment will be described with reference to the accompanying drawings. It is noted that like reference numerals refer to like parts throughout the various figures and exemplary embodiments. In certain embodiments, a detailed description of known functions and configurations that may obscure the gist of the present disclosure will be omitted. For the same reason, some of the elements in the drawings are exaggerated, omitted, or schematically illustrated.

Figure 2:
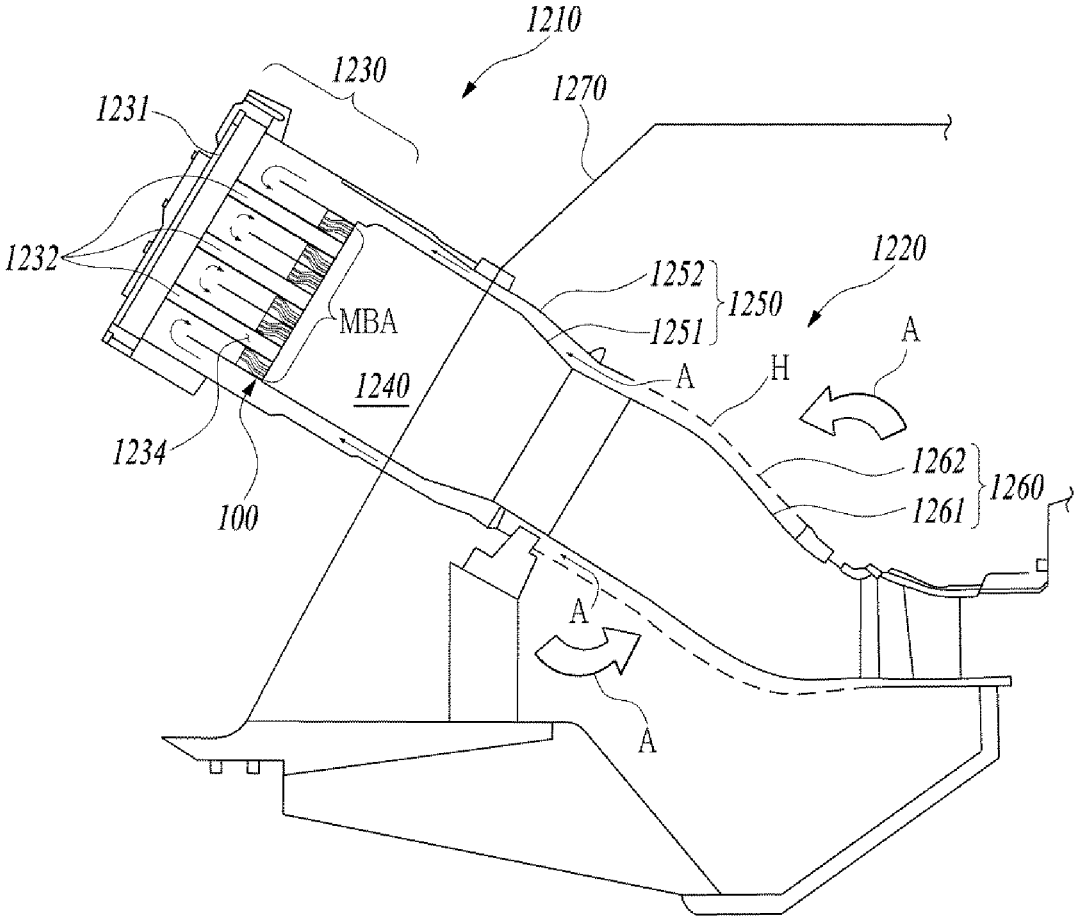
FIG. 2 is a view illustrating a burner module constituting a combustor according to an exemplary embodiment.

FIG. 1 is a view illustrating an interior of a gas turbine according to an exemplary embodiment, and FIG. 2 is a view illustrating a burner module constituting a combustor according to an exemplary embodiment.

Referring to FIGS. 1 and 2, a gas turbine 1000 includes a compressor 1100 that compresses incoming air to a high pressure, and a combustor 1200 that mixes compressed air compressed by the compressor with fuel and combusts an air-fuel mixture, and a turbine 1300 that generates rotational force with combustion gas generated in the combustor 1200. Here, an upstream and a downstream are defined based on a front and rear of the fuel or air flow.

An ideal thermodynamic cycle of a gas turbine may comply with a Brayton cycle. The Brayton cycle consists of four thermodynamic processes: isentropic compression (i.e., an adiabatic compression), isobaric combustion, isentropic expansion (i.e., an adiabatic expansion) and isobaric heat ejection. That is, in the Brayton cycle, thermal energy may be released by combustion of fuel in an isobaric environment after atmospheric air is sucked and compressed into high pressure air, hot combustion gas may be expanded to be converted into kinetic energy, and exhaust gas with residual energy may be discharged to the outside. As such, the Brayton cycle consists of four thermodynamic processes including compression, heating, expansion, and heat ejection.

The gas turbine 1000 employing the Brayton cycle includes the compressor 1100, the combustor 1200, and the turbine 1300. Although the following description will be described with reference to FIG. 1, the present disclosure may be widely applied to other turbine engines having similar configurations to the gas turbine 1000 illustrated in FIG. 1.

Referring to FIG. 1, the compressor 1100 of the gas turbine may suck and compress air. The compressor 1100 may supply the compressed air to the combustor 1200 and also supply the cooling air to a high temperature region of the gas turbine that is required to be cooled. Because the sucked air is compressed in the compressor 1100 through an adiabatic compression process, the pressure and temperature of the air passing through the compressor 1100 increases.

The compressor 1100 may be designed in a form of a centrifugal compressor or an axial compressor, wherein the centrifugal compressor is applied to a small-scale gas turbine, whereas a multi-stage axial compressor is applied to a large-scale gas turbine 1000 illustrated in FIG. 1 to compress a large amount of air.

The compressor 1100 is driven using a portion of the power output from a turbine 1300. To this end, a rotary shaft of the compressor 1100 and a rotary shaft of the turbine 1300 may be directly connected.

The combustor 1200 may mix the compressed air supplied from the compressor 1100 with fuel and combust the mixture at constant pressure to produce combustion gas with high energy.

The combustor 1200 is disposed downstream of the compressor 1100, and includes a plurality of burner modules 1210 annularly disposed around a center axis thereof.

Referring to FIG. 2, the burner module 1210 may include a combustion chamber assembly 1220 having a combustion chamber 1240 in which a fuel fluid burns, and a micro-mixer assembly 1230 having a plurality of micro-mixers 100 for injecting the fuel fluid into the combustion chamber 1240. The fuel fluid may be supplied from a fuel tank in which fuel (e.g., hydrogen) is stored.

The gas turbine 1000 may use gas fuel including hydrogen and natural gas, liquid fuel, or a combination thereof. In order to create a combustion environment for reducing emissions such as carbon monoxides, or nitrogen oxides, a gas turbine has a recent tendency to apply a premixed combustion scheme that is advantageous in reducing emissions through lowered combustion temperature and homogeneous combustion even though it is difficult to control the premixed combustion.

In case of premixed combustion, in the micro-mixer assembly 1230, the compressed air introduced from the compressor 1100 is mixed with fuel in advance, and then enters the combustion chamber 1240. When the premixed gas is initially ignited by an ignitor and then the combustion state is stabilized, a combustion state is maintained by supplying fuel and air.

The micro-mixer assembly 1230 includes a micro-mixer bundle assembly MBA. The MBA includes a plurality of micro-mixer bundles MB in which a plurality of micro-mixers 100 for injecting a mixed fuel fluid are disposed. The micro-mixer 100 mixes fuel with air in an appropriate ratio to form a fuel-air mixture having conditions suitable for combustion.

The plurality of micro-mixer bundles MB may include a single inner micro-mixer bundle and a plurality of circumferential micro-mixer bundles radially arranged around the inner micro-mixer bundle.

The combustion chamber assembly 1220 includes the combustion chamber 1240 in which combustion occurs, a liner 1250 and a transition piece 1260.

The liner 1250 is disposed on a downstream side of the micro-mixer assembly 1230 and may have a dual structure of an inner liner part 1251 and an outer liner part 1252 in which the inner liner part 1251 is surrounded by the outer liner part 1252. In this case, the inner liner part 1251 is a hollow tubular member, and the combustion chamber 1240 is an internal space of the inner liner part 1251. The inner liner part 1251 is cooled by the compressed air introduced into an annular space inside the outer liner part 1252 through inlet holes H.

The transition piece 1260 is disposed on a downstream side of the liner 1250 to guide the combustion gas generated in the combustion chamber 1240 toward the turbine 1300. The transition piece 1260 may have a dual structure of an inner transition piece part 1261 and an outer transition piece part 1262 in which the inner transition piece part 1261 is surrounded by the outer transition piece part 1262. The inner transition piece part 1261 is also formed of a hollow tubular member such that a diameter gradually decreases from the liner 1250 toward the turbine 1300. In this case, the inner liner part 1251 and the inner transition piece part 1261 may be coupled to each other by a plate spring seal. Because respective ends of the inner liner part 1251 and the inner transition piece part 1261 are fixed to the combustor 1200 and the turbine 1300, respectively, the plate spring seal may have a structure capable of accommodating expansion of length and diameter by thermal expansion to support the inner liner part 1251 and the inner transition piece part 1261.

As such, the inner liner part 1251 and the inner transition piece part 1261 have a structure surrounded by the outer liner part 1252 and the outer transition piece part 1262 so that compressed air may flow into the annular space between the inner liner part 1251 and into the outer liner part 1252 and the annular space between the inner transition piece part 1261 and the outer transition piece part 1262. The compressed air introduced into the annular spaces may cool the inner liner part 1251 and the inner transition piece part 1261.

In the meantime, high temperature and high pressure combustion gas generated by the combustor 1200 is supplied to the turbine 1300 through the liner 1250 and the transition piece 1260. In the turbine 1300, the combustion gas undergoes adiabatic expansion and impacts and drives a plurality of blades arranged radially around a rotary shaft of the turbine 1300 so that thermal energy of the combustion gas is converted into mechanical energy with which the rotary shaft rotates. A portion of the mechanical energy obtained from the turbine 1300 is supplied as the energy required to compress the air in the compressor 1100, and remaining is utilized as an available energy to drive a generator to produce electric power The combustor 1200 may further include a casing 1270 and an end cover 1231 coupled together to receive the compressed air A flowing into the burner module 1210. After the compressed air A flows into the annular space inside the liner 1250 or the transition piece 1260 through the inlet holes H, the flow direction of the compressed air A is changed by the end cover 1231 to the inside of the micro-mixer 100. The fuel F may be supplied to the micro-mixer 100 via a fuel plenum 1234 through a fuel passage 1232 and a plenum inlet 1234*a* and then supplied to the micro-mixer 100 through a supply port 112 to be mixed with compressed air.

Figure 3:
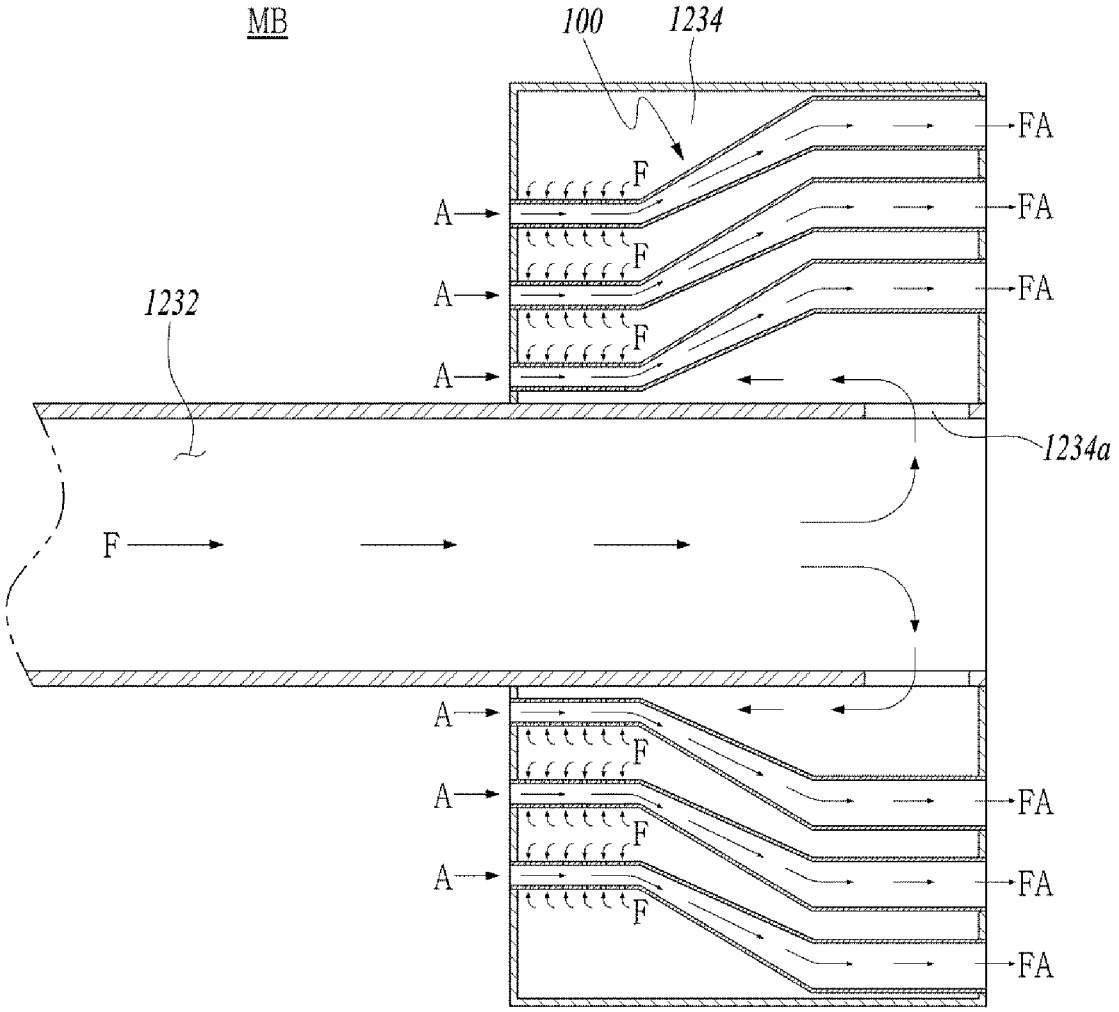
FIG. 3 is a side cross-sectional view illustrating a micro-mixer bundle according to an exemplary embodiment.
Figure 4:
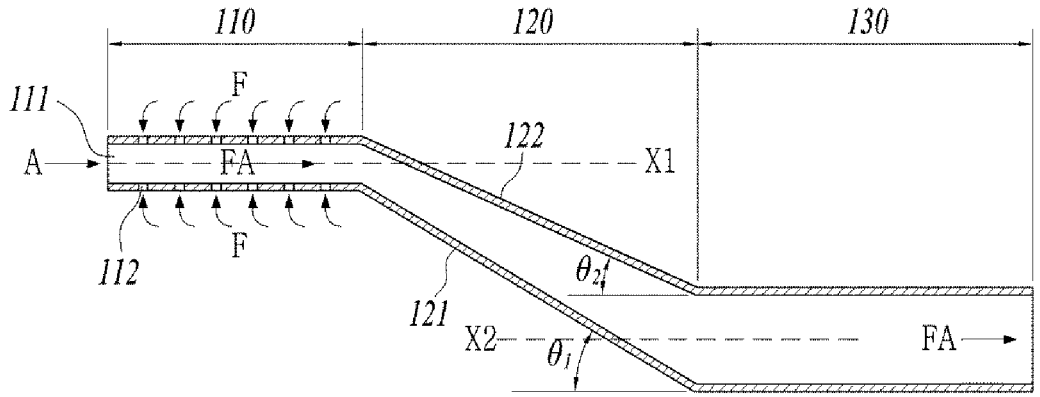
FIGS. 4 and 5 are side cross-sectional views illustrating a micro-mixer according to an exemplary embodiment.
Figure 5:
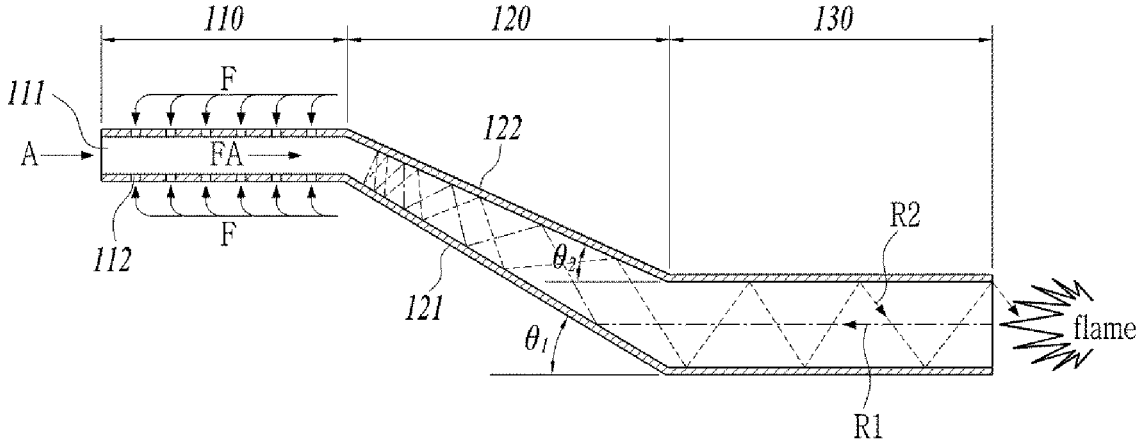

FIG. 3 is a side cross-sectional view illustrating a micro-mixer bundle according to an exemplary embodiment, and FIGS. 4 and 5 are side cross-sectional views illustrating a micro-mixer according to an exemplary embodiment.

Referring to FIGS. 3 to 5, the micro-mixer bundle MB includes a plurality of micro-mixers 100 and is formed to extend in a radial direction with respect to the fuel passage 1232. The micro-mixer 100 is formed to extend in a flow direction of fluid (e.g., fuel or air).

The micro-mixer 100 is formed in a form of a tube in which a cross-sectional area thereof is gradually increased as a middle part thereof is inclined as opposed to a general straight tube form, to reduce the transfer of radiant heat generated by a flame generated in the combustion chamber 1240 to the micro-mixer 100, thereby preventing spontaneous ignition and a flashback phenomenon occurring in the micro-mixer 100.

The micro-mixer 100 includes an inlet flow path 110, an inclined flow path 120, and an outlet flow path 130.

The inlet flow path 110 includes an inlet portion 111 formed on one end to flow air A, and feed holes 112 formed in a circumferential wall to supply fuel F. The air A introduced through the inlet portion 111 and the fuel F fed through the feed holes 112 are mixed in the inlet flow path 110 to form an air-fuel mixture FA to flow into the inclined flow path 120.

The inclined flow path 120 connected to the other end of the inlet flow path 110 is inclined at a predetermined angle. The air-fuel mixture FA flows along the inclined flow path 120 and the outlet flow path 130, and is injected into the combustion chamber 1240.

The outlet flow path 130 is formed to extend parallel to an imaginary extension line of the inlet flow path 110. That is, a flow axis (X1, a flow axis along a center line of the inlet flow path) of the air-fuel mixture FA flowing through the inlet flow path 110 and a flow axis X2 of the air-fuel mixture FA flowing through the outlet flow path 130 do not coincide with each other by the inclined flow path 120 and are spaced apart from each other in a predetermined distance and arranged in parallel. The imaginary extension line may be a flow axis of the air-fuel mixture FA.

The inclined flow path 120 is inclined at a predetermined angle to connect the inlet flow path 110 and the outlet flow path 130. The inclined flow path 120 connects the inlet flow path 110 and the outlet flow path 130 spaced apart from each other by a predetermined distance and is formed in the form of a tube in which the cross-sectional area thereof gradually increases from the inlet flow path 110 to the outlet flow path 130.

As a result, the inlet flow path 110 may have the smallest cross-sectional area and the outlet flow path 130 may have the largest cross-sectional area. That is, the inlet flow path 110 has a first cross-sectional area, the outlet flow path 130 has a second cross-sectional area larger than the first cross-sectional area, and the inclined flow path 120 has a variable cross-sectional area that gradually increases from the inlet flow path 110 to the outlet flow path 130.

In addition, the inclined flow path 120 includes a first wall line 121 at a lower portion and a second wall line 122 at an upper portion. The first wall line 121 forms a first angle θ1 with the imaginary extension line X2 of the outlet flow path 130, and the second wall line 122 forms a second angle θ2 with the imaginary extension line X2 of the outlet flow path 130. Because the inclined flow path 120 has a variable cross-sectional area, the first angle θ1 and the second angle θ2 may be formed at different angles.

As illustrated in FIG. 4, if the inclined flow path 120 is inclined downward, the first angle θ1 may be formed to be larger than the second angle θ2. Alternatively, if the inclined flow path 120 is inclined upward as in the micro-mixer 100 formed in the upper fuel plenum 1234 of FIG. 3, the second angle θ2 may be formed to be larger than the first angle θ1.

The cross-sectional areas of the inlet flow path 110, the inclined flow path 120, and the outlet flow path 130 may have a polygonal shape.

Referring to FIG. 5, a partial radiant heat R1 transferred to the micro-mixer 100 through the outlet flow path 130 among radiant heat generated in the radial direction by a flame generated in the combustion chamber 1240 does not reach the region of the inlet flow path 110 in which the fuel F and air A are mixed because the radiant heat R1 is repeatedly reflected on an inner wall of the inclined flow path 120 gradually decreasing in diameter, so the radiant heat R1 is discharged back to the combustion chamber 1240 through the outlet flow path 130 (i.e., radiant heat R2). Accordingly, it is possible to prevent spontaneous ignition and flashback phenomena caused by transfer of the radiant heat R1 to the region in which the fuel F and the air A are mixed.

On the other hand, according to the above-described exemplary embodiment, the fuel F is fed through the feed holes 112 in a state in which air A is introduced into the micro-mixer 100 to generate the air-fuel mixture FA. In this case, because the fuel F is fed at a low speed in a state in which the air A flows at a relatively high speed, there is a problem that the fuel and the air are not sufficiently mixed.

Next, a micro-mixer for improving mixing efficiency by supplying air A at high speed while fuel F flows through the micro-mixer at a relatively low speed according to another exemplary embodiment will be described.

Figure 6:
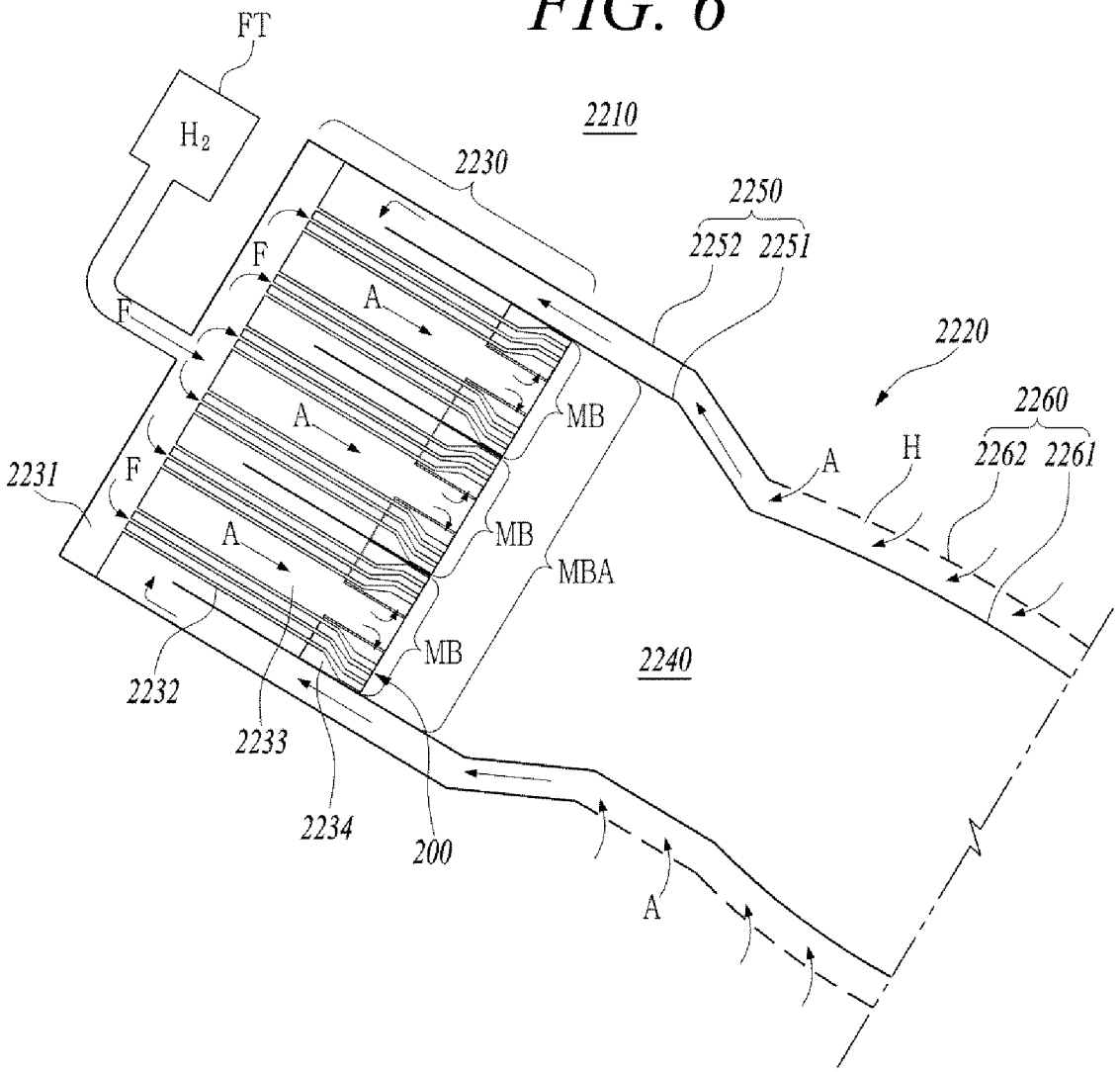
FIG. 6 is a view illustrating a burner module constituting a combustor according to another exemplary embodiment.
Figure 7:
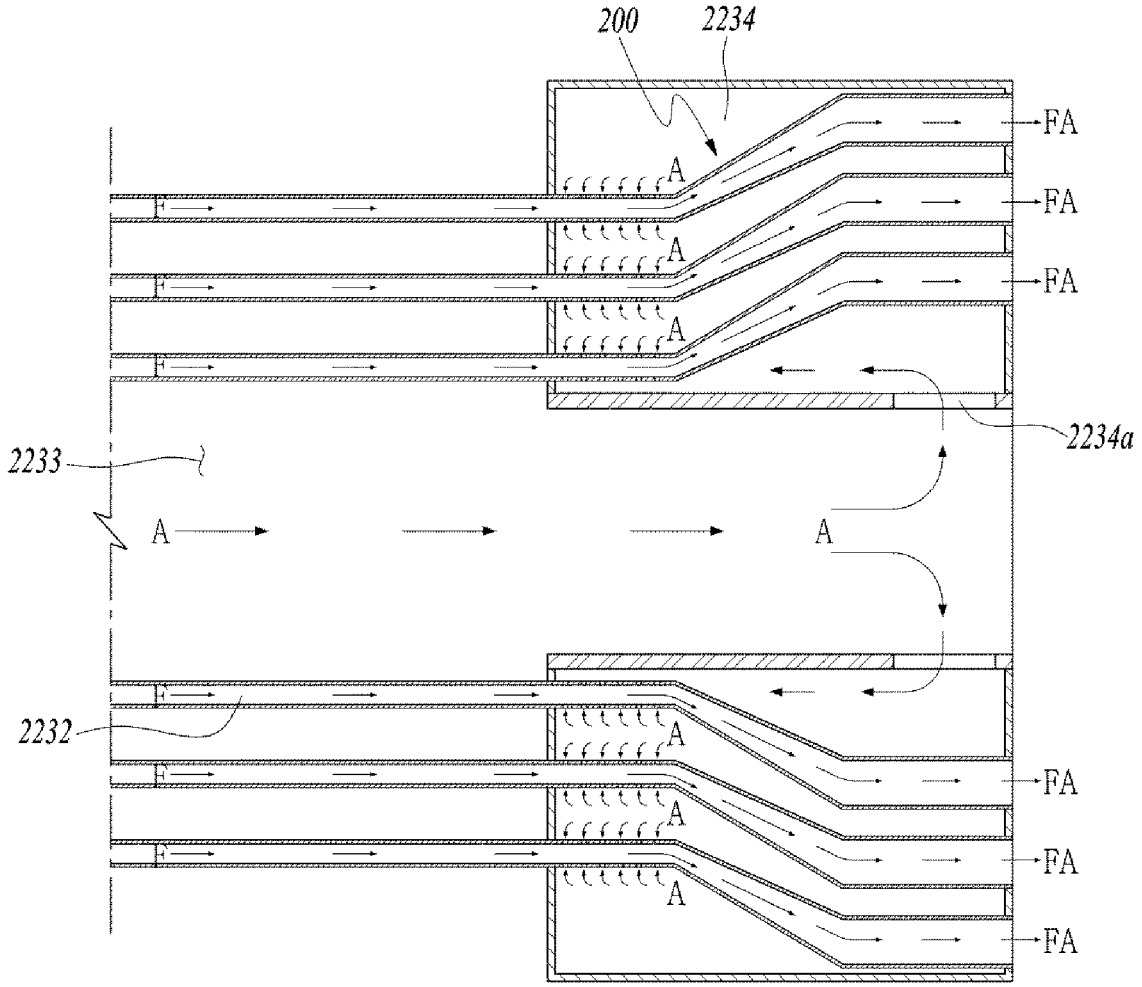
FIG. 7 is a side cross-sectional view illustrating a micro-mixer bundle according to another exemplary embodiment.
Figure 8:
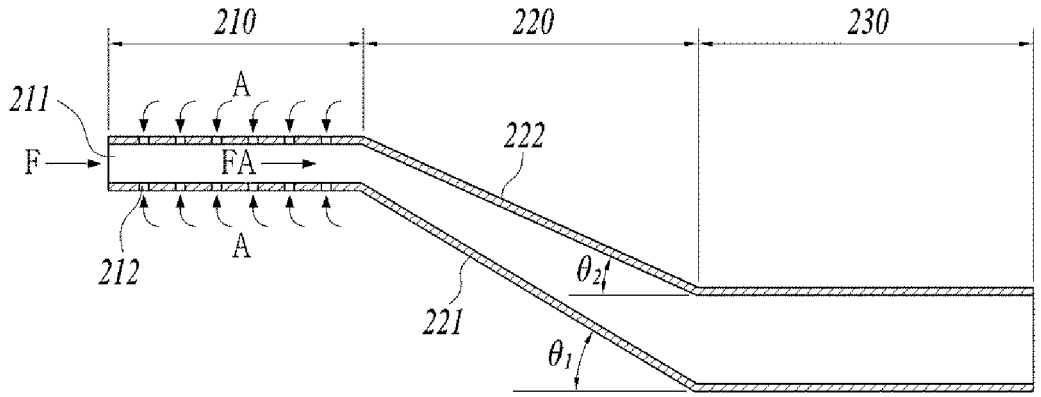
FIGS. 8 and 9 are side cross-sectional views illustrating a micro-mixer according to another exemplary embodiment.
Figure 9:
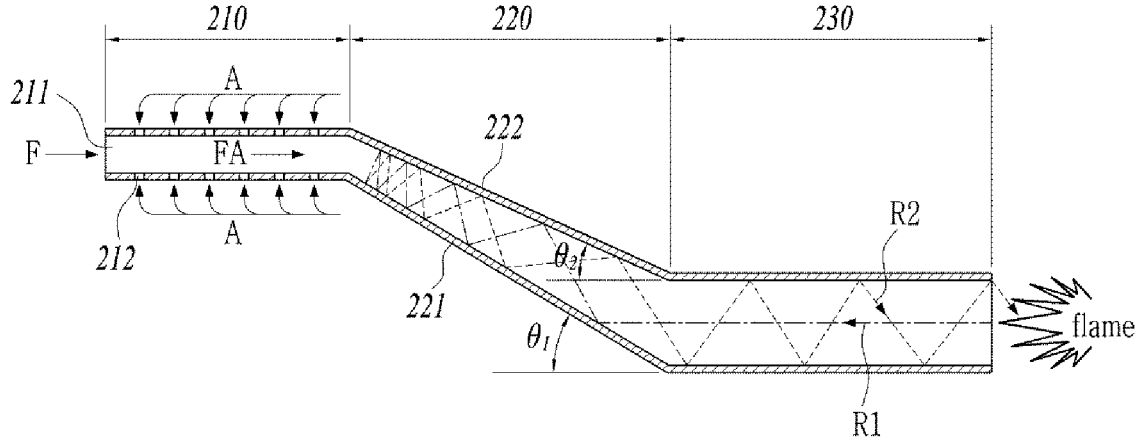

FIG. 6 is a view illustrating a burner module constituting a combustor according to another exemplary embodiment, FIG. 7 is a side cross-sectional view illustrating a micro-mixer bundle according to another exemplary embodiment, and FIGS. 8 and 9 are side cross-sectional views illustrating a micro-mixer according to another exemplary embodiment.

Referring to FIGS. 6 and 7, air A may be mixed in a state in which fuel F flows through a micro-mixer 200 in a burner module 2210.

A micro-mixer assembly 2230 includes a micro-mixer bundle assembly MBA. The micro-mixer bundle assembly MBA includes a plurality of micro-mixer bundles MB in which a plurality of micro-mixers 200 for injecting an air-fuel mixture are disposed.

The fuel F supplied from the fuel tank FT flows into the micro-mixer 200 via an end cover 2231 and a fuel passage 2232.

The compressed air A is introduced into an internal annular space of a liner 2250 or a transition piece 2260 through inlet holes H, and a flow direction thereof may be changed by the end cover 2231 to flow along an air flow space 2233 into an air plenum 2234 through a plenum inlet 2234*a*, and then flows into the micro-mixer 200 through feed holes 212 to be mixed with fuel F. Here, reference numeral 2220 denotes a combustion chamber assembly which is substantially the same as in the exemplary embodiment described above, so a repeated description thereof will be omitted.

Referring to FIGS. 7 to 9, the micro-mixer bundle MB includes a plurality of micro-mixers 200 and is formed to extend in a radial direction with respect to an imaginary central axis of the air flow space 2233. The micro-mixer 200 is formed to extend in a flow direction of fluid (e.g., fuel or air).

The micro-mixer 200 is formed in a form of a tube in which a cross-sectional area thereof is gradually increased as a middle part thereof is inclined as opposed to a general straight tube form, to reduce the transfer of radiant heat generated by a flame generated in the combustion chamber 2240 to the micro-mixer 200, thereby preventing spontaneous ignition and a flashback phenomenon occurring inside of the micro-mixer 200.

The micro-mixer 200 includes an inlet flow path 210, an inclined flow path 220, and an outlet flow path 230.

The inlet flow path 110 is connected to the fuel flow path 2232 and includes an inlet portion 211 formed on one end to flow fuel F and feed holes 212 formed in a circumferential wall to supply air A. The fuel F introduced through the inlet portion 211 and the air A supplied through the feed holes 212 are mixed in the inlet flow path 210 to form an air-fuel mixture FA to flow into the inclined flow path 220.

The inclined flow path 220 connected to the other end of the inlet flow path 210 is inclined at a predetermined angle. The air-fuel mixture FA flows along the inclined flow path 220 and the outlet flow path 230, and is injected into the combustion chamber 2240.

The outlet flow path 230 is formed to extend parallel to an imaginary extension line of the inlet flow path 210. That is, a flow axis (X1, a flow axis along a center line of the inlet flow path) of the air-fuel mixture FA flowing through the inlet flow path 210 and a flow axis X2 of the air-fuel mixture FA flowing through the outlet flow path 230 do not coincide with each other by the inclined flow path 120 and are spaced apart from each other in a predetermined distance and arranged in parallel. The imaginary extension line may be a flow axis of the air-fuel mixture FA.

The inclined flow path 220 is inclined at a predetermined angle to connect the inlet flow path 210 and the outlet flow path 230. The inclined flow path 220 connects the inlet flow path 210 and the outlet flow path 230 spaced apart from each other by a predetermined distance and is formed in the form of a tube in which the cross-sectional area gradually increases from the inlet flow path 210 to the outlet flow path 230.

As a result, the inlet flow path 210 may have the smallest cross-sectional area and the outlet flow path 230 may have the largest cross-sectional area. That is, the inlet flow path 210 has a first cross-sectional area, the outlet flow path 230 has a second cross-sectional area larger than the first cross-sectional area, and the inclined flow path 220 has a variable cross-sectional area that gradually increases from the inlet flow path 210 to the outlet flow path 230.

In addition, the inclined flow path 220 includes a first wall line 221 at a lower portion and a second wall line 222 at an upper portion. The first wall line 221 forms a first angle θ1 with the imaginary extension line X2 of the outlet flow path 230, and the second wall line 222 forms a second angle θ2 with the imaginary extension line X2 of the outlet flow path 230. Because the inclined flow path 220 has a variable cross-sectional area, the first angle θ1 and the second angle θ2 may be formed at different angles.

As illustrated in FIG. 8, if the inclined flow path 220 is inclined downward, the first angle θ1 may be formed to be larger than the second angle θ2. Alternatively, if the inclined flow path 220 is inclined upward as in the micro-mixer 200 formed in the upper air plenum 1234 of FIG. 7, the second angle θ2 may be formed to be larger than the first angle θ1.

The cross-sectional areas of the inlet flow path 210, the inclined flow path 220, and the outlet flow path 230 may have a polygonal shape.

Referring to FIG. 9, a partial radiant heat R1 transferred to the micro-mixer 200 through the outlet flow path 130 among radiant heat generated in the radial direction by a flame generated in the combustion chamber 2240 does not reach the region of the inlet flow path 210 in which the fuel F and air A are mixed because the radiant heat R1 is repeatedly reflected on an inner wall of the inclined flow path 220 gradually decreasing in diameter, so the radiant heat R1 is discharged back to the combustion chamber 2240 through the outlet flow path 230 (i.e., radiant heat R2). Accordingly, it is possible to prevent spontaneous ignition and flashback phenomena caused by transfer of the radiant heat R1 to the region in which the fuel F and the air A are mixed. In addition, the micro-mixer 200 can improve the mixing efficiency by supplying air A at high speed in a state in which fuel F flows at a relatively low speed through the micro-mixer 200.

Figure 10A:
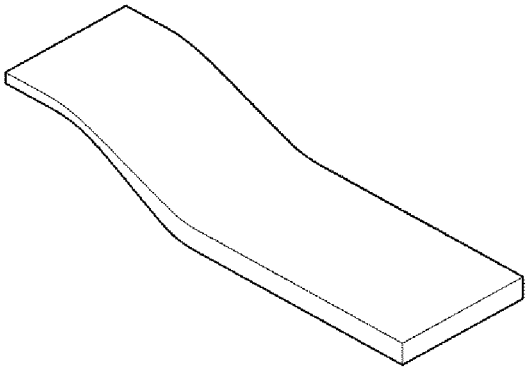
FIGS. 10A to 10C are perspective views illustrating various modifications of a micro-mixer according to exemplary embodiments.
Figure 10B:
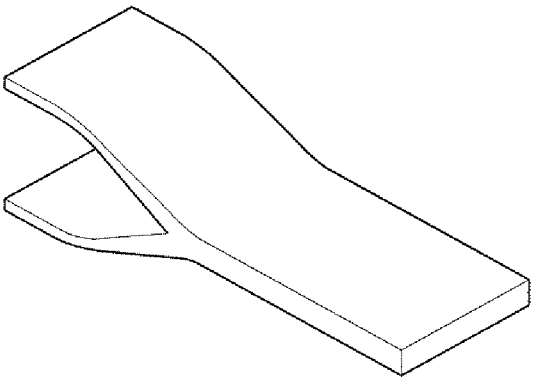
Figure 10C:
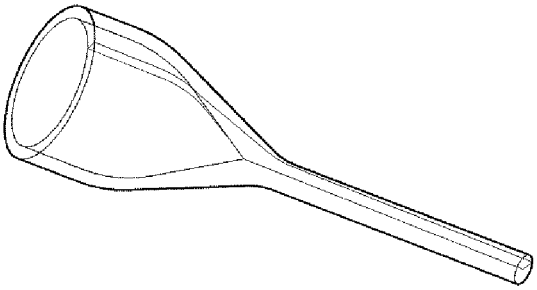
Figure 11A:
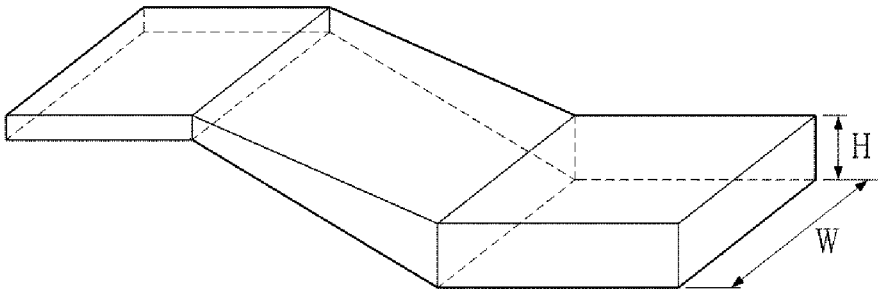
FIGS. 11A to 11C are perspective views illustrating various modifications of the micro-mixer illustrated in FIG. 10A.
Figure 11B:
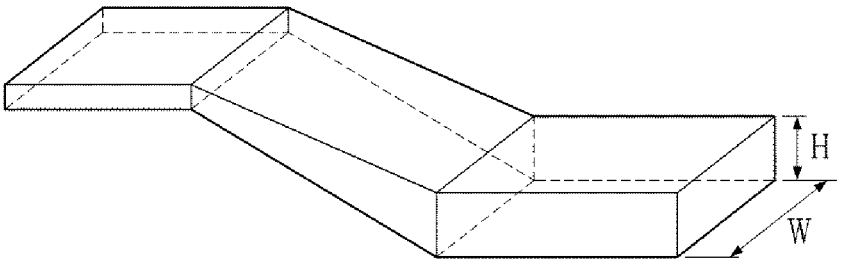
Figure 11C:
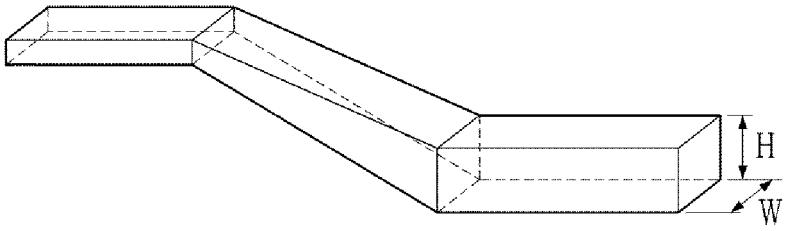

FIGS. 10A to 10C are perspective views illustrating various modifications of a micro-mixer according to exemplary embodiments, FIGS. 11A to 11C are perspective views illustrating various modifications of the micro-mixer illustrated in FIG. 10A, and FIGS. 12A to 12C are perspective views illustrating various modifications of the micro-mixers illustrated in FIGS. 10B and 10C.

The micro-mixers according to exemplary embodiments may be formed in various shapes as illustrated in FIGS. 10A to 12. Therefore, cross-sectional shapes of outlets of the micro-mixers may also be formed in various shapes.

Referring to FIGS. 10A and 10B, the cross-sectional shape of the outlets of the micro-mixers may be formed in a polygonal tube shape. Referring to FIGS. 11A to 11C, a width W and height H of the micro-mixers may be formed in various ways.

Referring to FIG. 10C, the cross-sectional shape of the outlet of the micro-mixers may be formed in a circular tube shape.

Figure 12A:
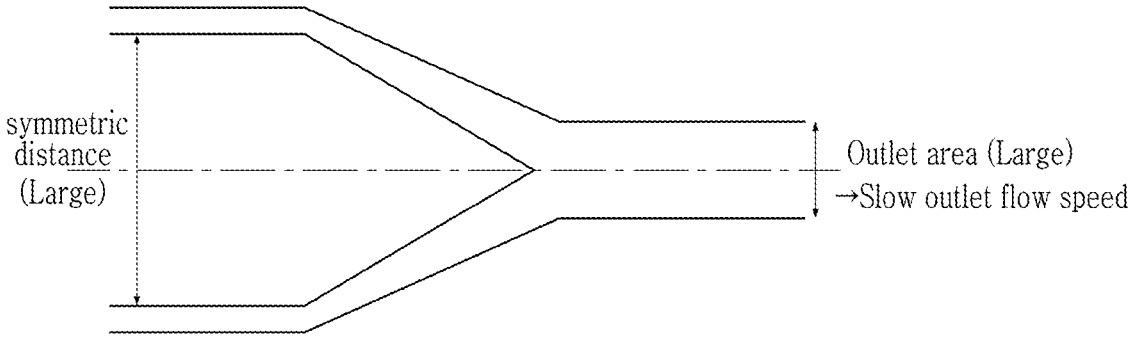
FIGS. 12A to 12C are perspective views illustrating various modifications of the micro-mixers illustrated in FIGS. 10B and 10C.
Figure 12B:
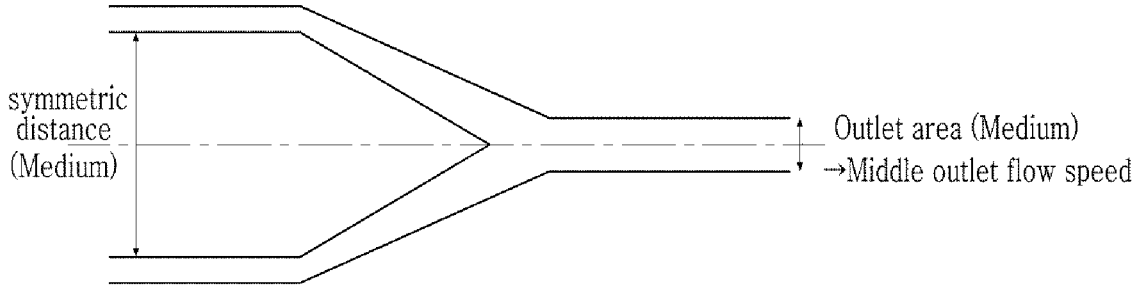
Figure 12C:
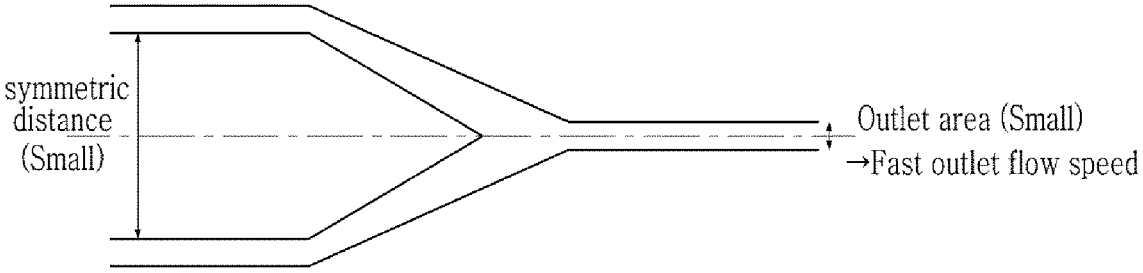

Referring to FIGS. 12A to 12C, if the cross-sectional shape of the outlet of the micro-mixers is formed in a circular or polygonal tube shape and two or more inlet flow paths are formed such that intervals between the inlet flow paths are different or the area of the outlet flow path is adjusted, the speed of fluid flowing through the micro-mixers may be adjusted.

Figure 13:
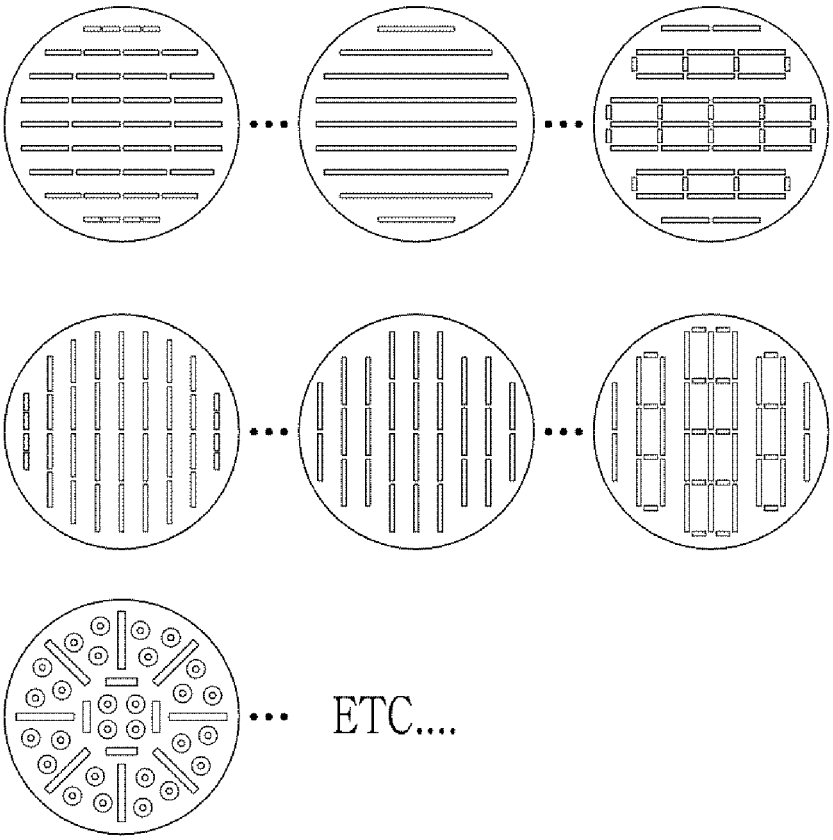
FIG. 13 is a diagram illustrating various forms of a micro-mixer bundle in which micro-mixers are arranged in various ways.
Figure 14:
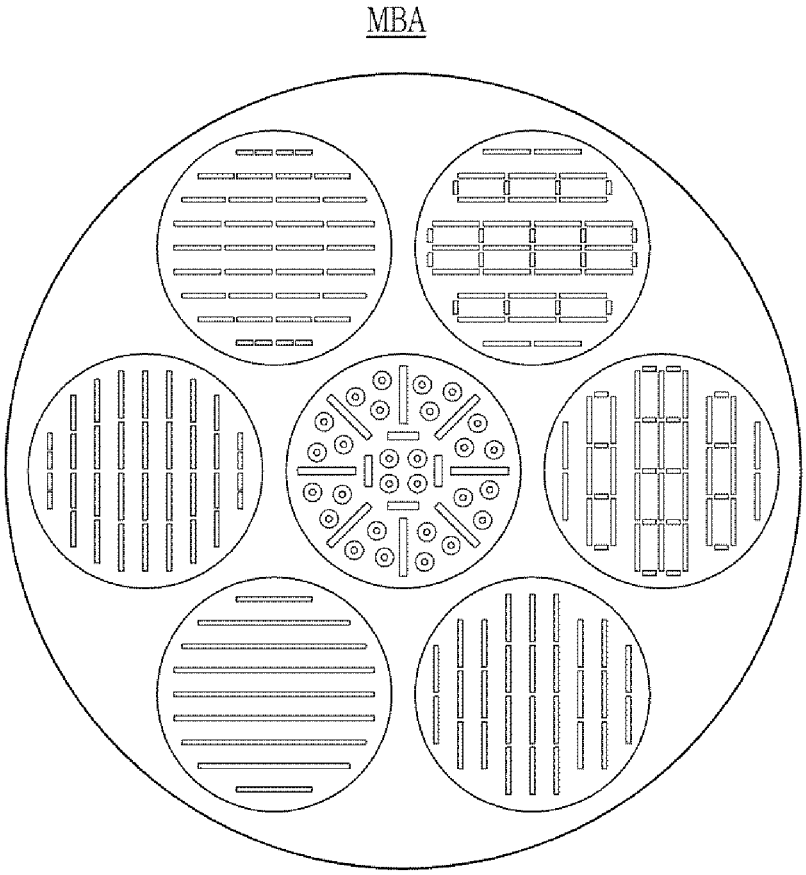
FIG. 14 is a diagram illustrating an example of a micro-mixer bundle assembly in which micro-mixer bundles illustrated in FIG. 13 are combined.

FIG. 13 is a diagram illustrating various forms of a micro-mixer bundle in which micro-mixers are arranged in various ways, and FIG. 14 is a diagram illustrating an example of a micro-mixer bundle assembly in which micro-mixer bundles illustrated in FIG. 13 are combined.

Referring to FIG. 13, the micro-mixers having various outlet cross-sectional shapes may be arranged in various combinations in a single micro-mixer bundle. In the micro-mixer bundle, micro-mixers having the same outlet cross-sectional shape or different outlet cross-sectional shapes may be arranged in various forms.

The micro-mixer bundles having various outlet cross-sectional shapes as illustrated in FIG. 13 may be configured in various combinations in a single micro-mixer bundle assembly MBA as illustrated in FIG. 14.

Referring to FIG. 14, in each micro-mixer bundle MB constituting one micro-mixer bundle assembly MBA, even when the outlet cross-sectional shapes of the micro-mixers disposed therein are the same, the micro-mixer array combination may form different outlet sections in the micro-mixer bundle MB.

Accordingly, the high frequency of each micro-mixer bundle MB generated by a hydrogen-containing fuel is different to solve the problem of combustion instability due to a high frequency resonance.

While one or more exemplary embodiments have been described with reference to the accompanying drawings, it will be apparent to those skilled in the art that various modifications and variations can be made through addition, change, omission, or substitution of components without departing from the spirit and scope of the disclosure as set forth in the appended claims, and these modifications and changes fall within the spirit and scope of the disclosure as defined in the appended claims.

What is claimed is:

1. A micro-mixer bundle assembly comprising:

a plurality of micro-mixers, each of the plurality of micro-mixers including an inlet portion formed on one side and through which a first fluid is introduced and a feed hole formed in a circumferential wall and through which a second fluid is fed, wherein the first fluid introduced through the inlet portion and the second fluid fed through the feed hole are mixed to form a fluid mixture which is injected into a combustion chamber; and a plurality of micro-mixer bundles, each of the plurality of micro-mixer bundles including the plurality of micro-mixers arranged therein, each of the plurality of micro-mixer bundles being circular, the plurality of micro-mixer bundles including a first micro-mixer bundle, a second micro-mixer bundle, and a third micro-mixer bundle, wherein a cross-sectional shape of an outlet of a first one of the micro-mixers disposed in the first micro-mixer bundle, a cross-sectional shape of an outlet of a second one of the micro-mixers disposed in the second micro-mixer bundle and a cross-sectional shape of an outlet of a third one of the micro-mixers disposed in the third micro-mixer bundle are different to each other, wherein the cross-sectional shape of the outlet of the first one of the micro-mixers disposed in the first micro-mixer bundle is a first rectangular shape and the cross-sectional shape of the outlet of the second one of the micro-mixers disposed in the second micro-mixer bundle is a second rectangular shape and the cross-sectional shape of the outlet of the third one of the micro-mixers disposed in the third micro-mixer bundle is circular, wherein a width direction of the first rectangular shape and a width direction of the second rectangular shape are perpendicular to each other.

2. The micro-mixer bundle assembly according to claim 1, wherein the micro-mixer bundles are arranged in a radial direction with respect to one of the micro-mixer bundles.

3. The micro-mixer bundle assembly according to claim 1, wherein the cross-sectional shape of the outlet of the first one of the micro-mixers disposed in the first micro-mixer bundle is formed to have a different shape from a cross-sectional shape of an outlet of a fourth one of the micro-mixers disposed in the first micro-mixer bundle.

4. The micro-mixer bundle assembly according to claim 1, wherein each of the micro-mixers comprises:

an inlet flow path having a first flow axis through which the fluid mixture flows, the inlet flow path including the inlet portion formed on the one side and the feed hole formed in the circumferential wall;

an outlet flow path having a second flow axis and injecting the fluid mixture into the combustion chamber, the second flow axis being parallel to the first flow axis and being spaced apart from the first flow axis; and an inclined flow path connecting the inlet flow path and the outlet flow path and formed inclined at a predetermined angle to reduce transfer of radiant heat by a flame generated in the combustion chamber to the inlet flow path.

5. The micro-mixer bundle assembly according to claim 4, wherein the inlet flow path has a first cross-sectional area, the outlet flow path has a second cross-sectional area greater than the first cross-sectional area, and the inclined flow path has a variable cross-sectional area that gradually increases from the inlet flow path to the outlet flow path.

6. The micro-mixer bundle assembly according to claim 4, wherein the inclined flow path comprises a first wall line forming a first angle with an imaginary extension line of the outlet flow path and a second wall line forming a second angle with the imaginary extension line of the outlet flow path, and the first angle and the second angle are different from each other.

7. The micro-mixer bundle assembly according to claim 1, wherein the first fluid is a hydrogen-containing fuel and the second fluid is air, or the first fluid is air and the second fluid is the hydrogen-containing fuel.

8. A combustor comprising:

a combustion chamber assembly including a combustion chamber in which a fuel air mixture combusts; and a micro-mixer assembly including a micro-mixer bundle assembly to inject the fuel air mixture into the combustion chamber, the micro-mixer bundle assembly comprising:

a plurality of micro-mixers, each of the plurality of micro-mixers including an inlet portion formed on one side and through which a first fluid is introduced and a feed hole formed in a circumferential wall and through which a second fluid is fed, wherein the first fluid introduced through the inlet portion and the second fluid fed through the feed hole are mixed to form the fuel air mixture which is injected into the combustion chamber; and a plurality of micro-mixer bundles, each of the plurality of micro-mixer bundles including the plurality of micro-mixers arranged therein, each of the plurality of micro-mixer bundles being circular, the plurality of micro-mixer bundles including a first micro-mixer bundle, a second micro-mixer bundle, and a third micro-mixer bundle, wherein a cross-sectional shape of an outlet of a first one of the micro-mixers disposed in the first micro-mixer bundle, a cross-sectional shape of an outlet of a second one of the micro-mixers disposed in the second micro-mixer bundle and across-sectional shape of an outlet of a third one of the micro-mixers disposed in the third micro-mixer bundle are different to each other, wherein the cross-sectional shape of the outlet of the first one of the micro-mixers disposed in the first micro-mixer bundle is a first rectangular shape and the cross-sectional shape of the outlet of the second one of the micro-mixers disposed in the second micro-mixer bundle is a second rectangular shape and the cross-sectional shape of the outlet of the third one of the micro-mixers disposed in the third micro-mixer bundle is circular, wherein a width direction of the first rectangular shape and a width direction of the second rectangular shape are perpendicular to each other.

9. The combustor according to claim 8, wherein the micro-mixer bundles are arranged in a radial direction with respect to one of the micro-mixer bundles.

10. The combustor according to claim 8, wherein the cross-sectional shape of the outlet of the first one of the micro-mixers disposed in the-first micro-mixer bundle is formed to have a different shape from a cross-sectional shape of an outlet of a fourth one of the micro-mixers disposed in the first micro-mixer bundle.

11. The combustor according to claim 8, wherein each of the micro-mixers comprises:

an inlet flow path having a first flow axis through which the fuel air mixture flows, the inlet flow path including the inlet portion formed on the one side and the feed hole formed in the circumferential wall;

an outlet flow path having a second flow axis and injecting the fuel air mixture into the combustion chamber, the second flow axis being parallel to the first flow axis and being spaced apart from the first flow axis; and an inclined flow path connecting the inlet flow path and the outlet flow path and formed inclined at a predetermined angle to reduce transfer of radiant heat by a flame generated in the combustion chamber to the inlet flow path.

12. The combustor according to claim 11, wherein the inlet flow path has a first cross-sectional area, the outlet flow path has a second cross-sectional area greater than the first cross-sectional area, and the inclined flow path has a variable cross-sectional area that gradually increases from the inlet flow path to the outlet flow path.

13. The combustor according to claim 11, wherein the inclined flow path comprises a first wall line forming a first angle with an imaginary extension line of the outlet flow path and a second wall line forming a second angle with the imaginary extension line of the outlet flow path, and the first angle and the second angle are different from each other.

14. The combustor according to claim 11, wherein the first fluid is a hydrogen-containing fuel and the second fluid is air, or the first fluid is air and the second fluid is the hydrogen-containing fuel.

15. A gas turbine comprising:

a compressor configured to provide compressed air;

a combustor configured to mix the compressed air provided by the compressor with fuel to produce a fuel air mixture and combust the fuel air mixture to produce combustion gas; and a turbine configured to generate power with the combustion gas produced by the combustor, wherein the combustor comprises:

a combustion chamber assembly including a combustion chamber in which the fuel air mixture combusts; and a micro-mixer assembly including a micro-mixer bundle assembly to inject the fuel air mixture into the combustion chamber, wherein the micro-mixer bundle assembly comprises:

a plurality of micro-mixers, each of the plurality of micro-mixers including an inlet portion formed on one side and through which a first fluid is introduced and a feed hole formed in a circumferential wall and through which a second fluid is fed, wherein the first fluid introduced through the inlet portion and the second fluid fed through the feed hole arc mixed to form the fuel air mixture which is injected into the combustion chamber; and a plurality of micro-mixer bundles, each of the plurality of micro-mixer bundles including the plurality of micro-mixers arranged therein, each of the plurality of micro-mixer bundles being circular, the plurality of micro-mixer bundles including a first micro-mixer bundle, a second micro-mixer bundle, and a third micro-mixer bundle, wherein a cross-sectional shape of an outlet of a first one of the micro-mixers disposed in the first micro-mixer bundle, a cross-sectional shape of an outlet of a second one of the micro-mixers disposed in the second micro-mixer bundle and a cross-sectional shape of an outlet of a third one of the micro-mixers disposed in the third micro-mixer bundle are different to each other, wherein the cross-sectional shape of the outlet of the first one of the micro-mixers disposed in the first micro-mixer bundle is a first rectangular shape and the cross-sectional shape of the outlet of the second one of the micro-mixers disposed in the second micro-mixer bundle is a second rectangular shape and the cross-sectional shape of the outlet of the third one of the micro-mixers disposed in the third micro-mixer bundle is circular, wherein a width direction of the first rectangular shape and a width direction of the second rectangular shape are perpendicular to each other.

16. The gas turbine according to claim 15, wherein the micro-mixer bundles are arranged in a radial direction with respect to one of the micro-mixer bundles.

17. The gas turbine according to claim 15, wherein the cross-sectional shape of the outlet of the first one of the micro-mixers disposed in the first micro-mixer bundle is formed to have a different shape from a cross-sectional shape of an outlet of a fourth one of the micro-mixers disposed in the first micro-mixer bundle.

18. The gas turbine according to claim 15, wherein each of the micro-mixers comprises:

an inlet flow path having a first flow axis through which the fuel air mixture flows, the inlet flow path including the inlet portion formed on the one side and the feed hole formed in the circumferential wall;

an outlet flow path having a second flow axis and injecting the fuel air mixture into the combustion chamber, the second flow axis being parallel to the first flow axis and being spaced apart from the first flow axis; and an inclined flow path connecting the inlet flow path and the outlet flow path and formed inclined at a predetermined angle to reduce transfer of radiant heat by a flame generated in the combustion chamber to the inlet flow path.

19. The gas turbine according to claim 18, wherein the inlet flow path has a first cross-sectional area, the outlet flow path has a second cross-sectional area greater than the first cross-sectional area, and the inclined flow path has a variable cross-sectional area that gradually increases from the inlet flow path to the outlet flow path.

20. The gas turbine according to claim 18, wherein the inclined flow path comprises a first wall line forming a first angle with an imaginary extension line of the outlet flow path and a second wall line forming a second angle with the imaginary extension line of the outlet flow path, and the first angle and the second angle are different from each other.

* * * * *